US005526613A

United States Patent [19]

Simeone, Jr.

[11] Patent Number: 5,526,613

[45] Date of Patent: Jun. 18, 1996

[54] ROOF DRAIN ASSEMBLY

[76] Inventor: Joseph A. Simeone, Jr., 30 Coachman's La., Woodbridge, Conn. 06525

[21] Appl. No.: 364,780

[22] Filed: Dec. 27, 1994

[51] Int. Cl.[6] ..... F04D 13/04

[52] U.S. Cl. ..... 52/12; 52/302.1; 210/163; 285/42

[58] Field of Search ..... 52/12, 302.1; 210/163; 285/42

[56] References Cited

U.S. PATENT DOCUMENTS

| | | | |
|---|---|---|---|
| 1,538,924 | 5/1925 | Boosey | 210/163 |
| 1,601,498 | 9/1926 | Hirstein | 210/163 X |
| 1,761,257 | 6/1930 | Fleming | 285/42 X |
| 1,838,092 | 12/1931 | Cromwell | 285/42 |
| 2,094,434 | 9/1937 | Sherriff | 210/163 X |
| 2,121,613 | 6/1938 | Schultz . | |
| 2,256,626 | 9/1941 | Rile . | |
| 2,427,258 | 9/1947 | Cavalieri . | |
| 2,666,493 | 1/1954 | Gordon . | |
| 2,928,419 | 3/1960 | Kruse . | |
| 3,357,561 | 12/1967 | Schmid et al. . | |
| 5,234,582 | 8/1993 | Savoie . | |

*Primary Examiner*—Carl D. Friedman
*Assistant Examiner*—Christopher Todd Kent
*Attorney, Agent, or Firm*—Melvin I. Stoltz

[57] ABSTRACT

By incorporating an elongated, generally upstanding, aperture-bearing tube member in the top of a roof drain cover or debris guard, with said elongated pipe extending into the interior of the roof drain assembly, a unique roof drain system is achieved which virtually eliminates clogging of the drain by debris, water, ice or snow buildup. By incorporating the upstanding, elongated pipe member, a safety overflow system is provided which establishes a clog-free flow path for carrying away any water buildup that might otherwise occur from clogged drain covers. Preferably, a generally cylindrically-shaped, elongated tube member is employed which is adjustably mounted to the roof drain cover or debris guard for telescopic, axial adjustable movement relative thereto. In this way, the length of the tube member exposed above the drain cover is adjustable, in order to accommodate alternate roof constructions and drainage problems.

13 Claims, 2 Drawing Sheets

ROOF DRAIN ASSEMBLY

TECHNICAL FIELD

Figure 1:
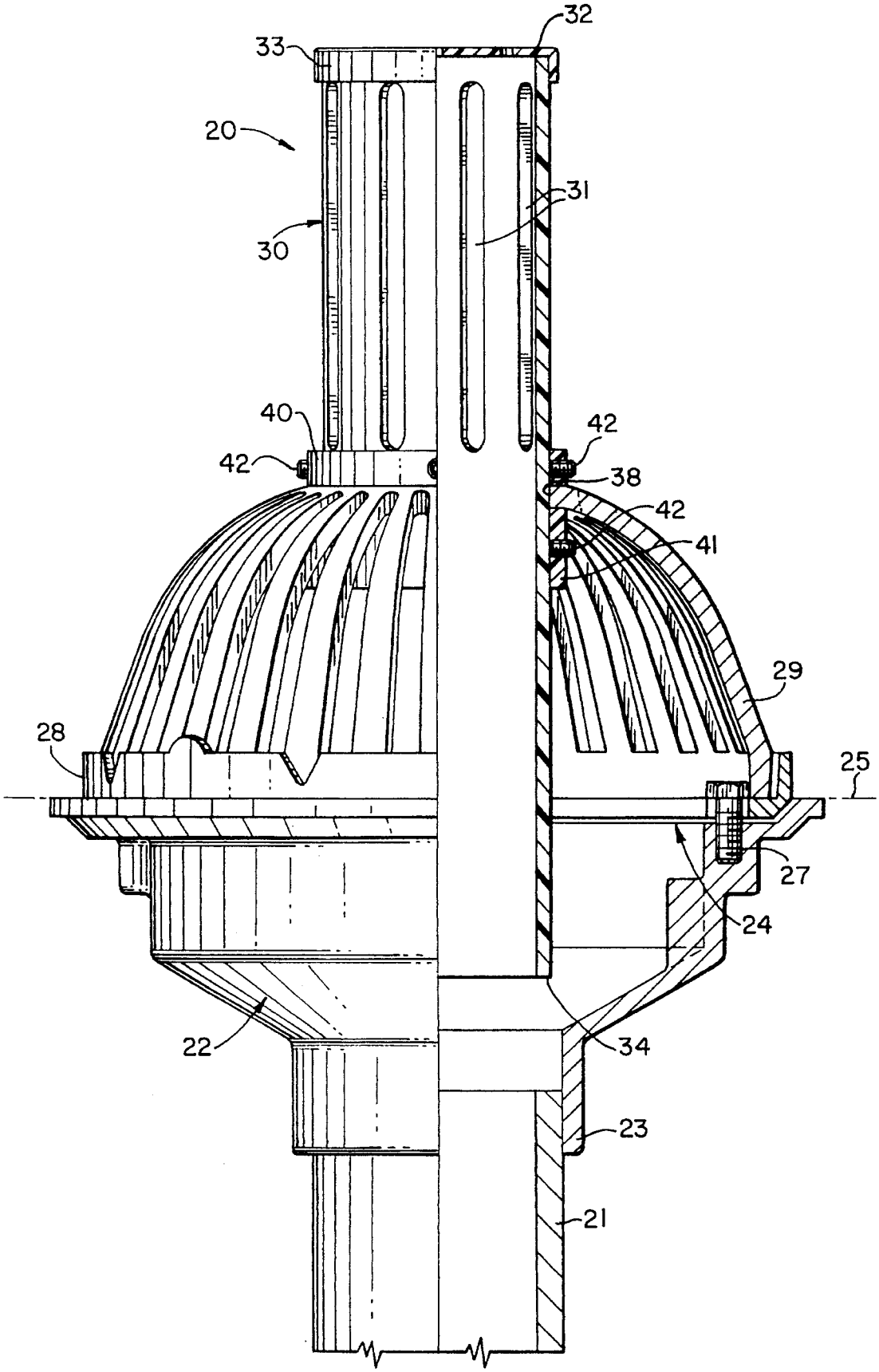

This invention relates to roof drain constructions and, more particularly, to roof drain constructions for use on flat roofs and low pitched roofs to control the flow or drain-off of water accumulated thereon.

BACKGROUND ART

Drainage systems or roof drains are employed on most buildings to assist in controlling the flow of water running off from the roofs of buildings during rain storms, snow storms and the like. Although such drainage systems or roof drain assemblies have long existed and have been constructed in a wide and diverse manner, certain conditions have recently arisen that have endangered the safety of low sloped or flat roofs which do not have perimeter gutters or eaves which allow the water to flow off automatically.

In most constructions, buildings are formed with sloping or pitched roofs which allow rain water or water from melting snow and ice to flow off of the roof automatically due to the pitch angle. In most locations, perimeter gutters are employed in order to catch the water run-off and control the flow of the water to desired locations. However, in buildings or structures wherein a flat or low sloped roof is employed, the drainage of rain water or snow therefrom becomes a more severe and difficult problem.

In many buildings, a flat or low sloped roof is employed and has a peripherally surrounding parapet or abutment preventing the rain water from automatically flowing off of the roof. Although these roofs typically have an inward draining slope feeding into a central roof drain, the conventional roof drains commonly found on most of these roofs suffer from severe clogging problems, which prevent satisfactory drainage. Due to heavier than normal snowfall as well as unusually cold winters, snow and ice buildup has combined with debris, such as leaves, twigs, branches, etc. to cause the drain to clog. As a result, water often builds up on flat roofs which reduces the normal safe weight carry capacity originally designed into the roof structure. In addition, water seepage through the roof often occurs, causing damage to interior structures.

This problem of clogging roof drains in combination with heavier than normal snowfall during the winter months has caused several buildings throughout the country to experience actual collapse of the roof structure. In many jurisdictions throughout the United States, building codes have been changed to require parapets on flat roof buildings to be breached, in order to prevent roof flooding and allow water buildup to escape from the roof surface, as a safeguard against the collapse of the roof due to flooding.

In order to address these problems, many jurisdictions now require that new flat or low sloped roof constructions must incorporate a structure which will cause any water to flow in a single direction towards a roof drain, whether the drain employed constitutes perimeter gutters, spill-overs, or interior roof drains. Typically, these new building codes are not limited to only new structures but also apply to any existing structure which is being re-roofed or upgraded. Although these new requirements address this problem area, the conventional roof drains often become clogged with debris, ice, or snow, thereby preventing effective water flow control.

Another problem that repeatedly occurs in both existing flat and low pitched roofs which are being re-roofed or upgraded, as well as in such new roof constructions, is the incorporation of heavy insulation to reduce heat loss through the roof. Although heavy insulation may be desirable for heat retention within the building, the reduction of heat escaping through the roof reduces the rate of melting of the snow or ice existing on the roof. As a result, heavier accumulations of snow and ice occur on the roof, imposing a heavier load on the structure than was originally anticipated. In addition, by having an increased buildup of snow and ice on the roof, the normal drainage system installed on the roof can be overloaded or clogged, further compounding the build-up of an excessive weight on the roof structure, as well as the buildup of excess water.

These problems are further compounded with rapid changes in winter temperatures, where snow and ice buildup continues from earlier accumulations or for substantially longer periods of time than were originally contemplated. As a result, additional snow fall or heavy rain causes further clogging and the overloaded clogged drains are rendered effectively useless. As a result, the roof structure is exposed to an ever-increasing weight load as well as water damage due to seepage. Due to problems of this nature, it has been documented that roofs have collapsed with heavy rainfall or snowfall when the built-in structural maximum load design factors have been exceeded.

A further problem that has occurred due to these difficulties is found with cap flashings which peripherally surround abutting items such as sky lights, walls, vent stacks and equipment placed on the roof. Although cap flashings are designed to be sufficient to accommodate normal levels of snow and water accumulations on roofs, difficulty in removing water has caused the normal level to be exceeded. As a result, equipment and interior areas are being subjected to water exposure where none was anticipated. This not only affects the safety of the roof and the equipment's longevity, but also causes water to enter under the flashings and create interior wall damage or interior flooding.

Another problem that has plagued prior art drainage devices in general and roof drains in particular is the inability of the roof drain construction to satisfactorily deal with accumulation of debris frequently found on roofs. As discussed above, although snow and ice accumulation represents a substantial problem against which prior art roof drain structures have attempted to deal, a substantially greater problem that occurs is clogging of the roof drain grating or strainer by debris, such as leaves, twigs, branches, etc.

In most buildings, roof maintenance is minimal if existent at all. Consequently, buildup of debris around the roof drain usually goes unnoticed for long periods of time, allowing debris to continuously build until the entire roof drain grating or strainer has been virtually surrounded and realistically closed by an accumulation of such debris. This debris accumulation further compounds and exasperates the problems caused by snow and ice buildups, preventing the normal passage of water run-off to be achieved and allowing excessive weight loads and water levels to buildup on the roof surface.

Although many prior art systems have been developed in an attempt to overcome these prior art difficulties, prior art systems have been incapable of satisfactorily eliminating the hazards resulting from debris, snow, and ice buildup on the roof. Typically, drains or sumps with different sized and shaped domes or strainers have been employed using a plurality of alternate constructions and slot arrangements in an attempt to satisfy the need for adequate drainage. In spite of this extensive effort, the problems have not been overcome.

One method which has been employed in some constructions is the use of dual drains installed at different elevations in order to have a secondary drainage system which will function if the primary drainage system, at the lowest level, fails to operate properly. Although the employment of dual drains can be successful in overcoming some of the prior art difficulties presently occurring in flat and low sloped roofs, this approach is extremely expensive and is not a universal solution for all presently existing problems. In addition, since the use of dual drainage systems at alternate height levels is extremely expensive, the approach is often precluded due to its additional cost.

Therefore, it is a principal object of the present invention to provide a roof drain assembly for use on flat roofs and low slope roofs which is capable of virtually eliminating unwanted water accumulation due to clogging or backup from debris, ice and snow.

Another object of the present invention is to provide a roof drainage assembly having the characteristic features described above which is capable of being easily installed on virtually all flat and low sloped roofs with complete assurance that unwanted clogging or water accumulation will be eliminated.

Another object of the present invention is to provide a roof drain assembly having the characteristic features described above which is easily installed in both new and existing roof constructions with complete compatibility.

Another object of the present invention is to provide a roof drain assembly having the characteristic features described above which is highly effective in eliminating excess water accumulation which is also economical to employ.

Other and more specific objects will in part be obvious and will in part appear hereinafter.

SUMMARY OF THE INVENTION

By employing the present invention, all of the difficulties and drawbacks found in prior art roof drain constructions have been overcome and a new, unique, roof drain system is achieved which virtually eliminates clogging of the drain by debris, water, ice or snow buildup. In accordance with the present invention, the prior art difficulties are eliminated by incorporating an elongated, generally upstanding tube member in the top of the roof drain cover or debris guard, with said elongated pipe extending into the interior of the roof drain assembly. By incorporating this upstanding, elongated pipe member, a safety overflow system is provided which establishes a clog-free flow path for carrying away any water buildup that might otherwise occur from clogged drain covers.

In the preferred embodiment, a generally cylindrically-shaped, elongated tube member is employed which is adjustably mounted to the roof drain cover or debris guard for telescopic, axial adjustable movement relative thereto. In this way, the length of the tube member exposed above the drain cover is adjustable, in order to accommodate alternate roof constructions and drainage problems.

In the preferred construction, the elongated tube member is also axially adjustable inwardly of the roof drain assembly. In the preferred embodiment, the inside terminating edge of the elongated tube member is positioned below the strainer dome or cover in juxtaposed, spaced cooperating relationship with the edge of principal fluid carrying, storm water or soil drain pipe. In addition, the terminating edge of the elongated tube member is also preferably positioned below the roof line, to produce a low pressure zone whenever heavy water buildup flows therethrough. In this way, dislodgement of some debris from the dome or cover is likely to be achieved.

It has also been found that in the preferred construction, the elongated, axially adjustable tube member preferably comprises a substantially cylindrical shape possessing a plurality of perforations, slots or apertures formed in the side thereof spaced above the strainer dome or cover of the roof drain assembly. In this way, the free flow of any excess water is provided. In addition, the terminating end of the tube member extending outwardly of the roof drain assembly comprises a closed end or cap, which is also perforated, in order to assure the free flow of water therethrough.

In addition, the preferred embodiment of the elongated tube member of the present invention is constructed with a diameter substantially equal to the diameter of the storm water or soil drain pipe. In this way, assurance is provided that any water buildup that has occurred will be easily handled by both the tube member and the drain system itself. Furthermore, this construction optimizes the flow of water through the tube member in a manner which will maximize dislodgement of debris from the dome or cover.

The invention accordingly comprises an article of manufacture possessing the features, properties, and relation of elements which will be exemplified in the article hereinafter described and the scope of the invention will be indicated in the claims.

THE DRAWINGS

Figure 2:
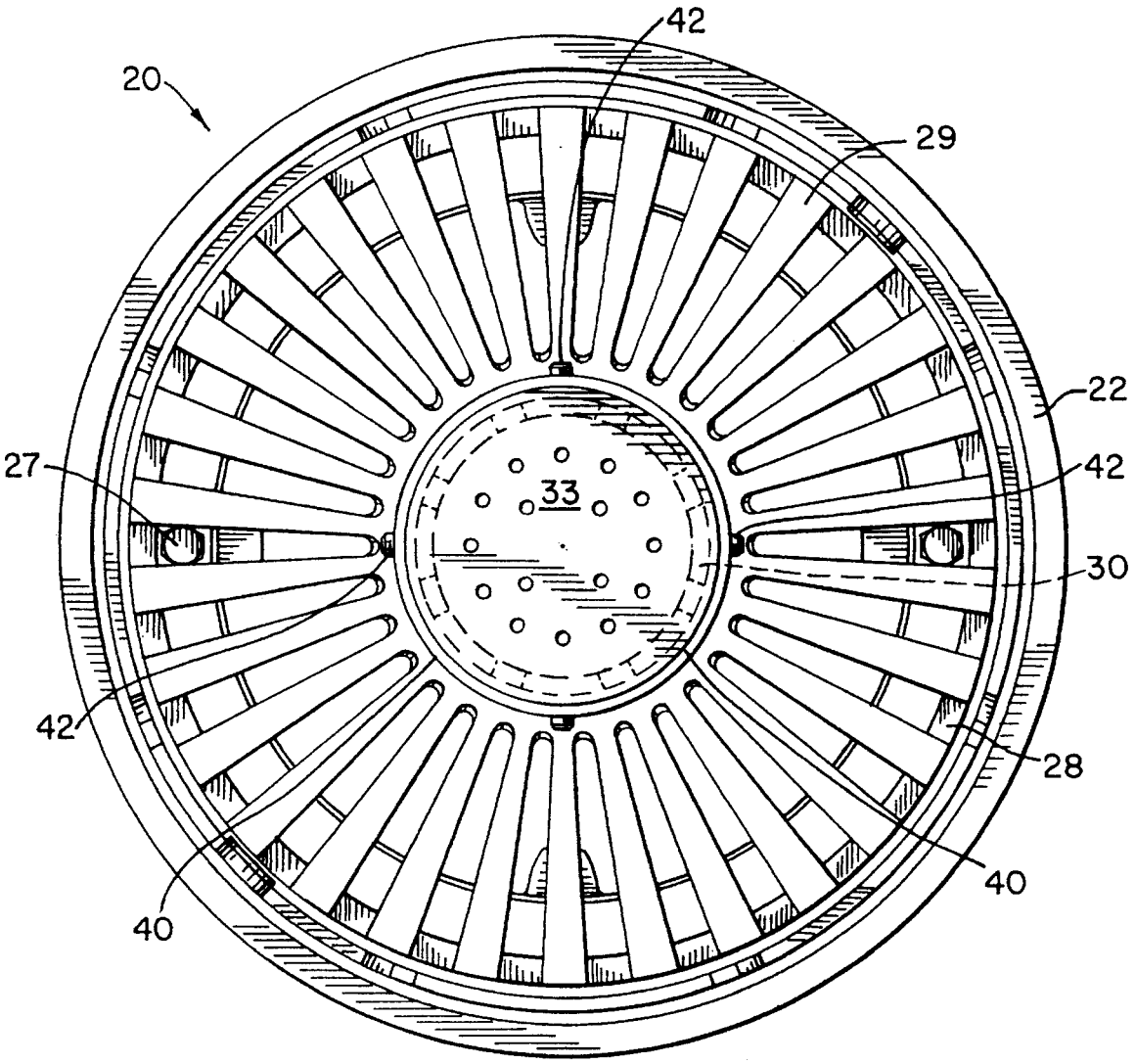

For a fuller understanding of the nature and objects of the invention, reference should be had to the following detailed description taken in connection with the accompanying drawings, in which:

FIG. 1 is a side elevation view, partially in cross-section and partially broken away, of the roof drain assembly of the present invention; and FIG. 2 is a top plan view of the roof drain assembly of FIG. 1.

DETAILED DISCLOSURE

By referring to FIGS. 1 and 2, along with the following detailed disclosure, the construction and operation of roof drain assembly 20 of the present invention can best be understood. In addition, as will be evident from the following disclosure, the roof drain assembly of this invention may be constructed in a plurality of alternate sizes and shapes without departing from the scope of this invention. Consequently, the roof drain assembly depicted in FIGS. 1 and 2 and described herein is intended to be illustrative of the overall invention and is not intended as a limitation of the present invention to this specific embodiment.

In typical structures requiring roof drains, an elongated storm water or soil pipe 21 is installed adjacent or directly below the roof extending therefrom to the ground or holding tank for receiving the water run-off from the roof. In order to interface with storm water or soil pipe 21 and provide a receiving zone for the water entering roof drain assembly 20, an enlarged sump or collection basin 22 is mounted to the terminating end of pipe 21. As shown in FIG. 1, sump or catch basin 22 incorporates a collar 23 which peripherally surrounds the outer diameter of pipe 21 and is securely affixed thereto. The remaining portion of sump or catch basin 22 extends outwardly from collar 23 forming an enlarged, smooth wall, water receiving zone, terminating with an enlarged open entry portal 24. Typically, entry portal 24 of sump or catch basin 22 is positioned substantially level with the top surface of roof 25, with the remainder of basin 22 extending below roof 25.

Roof drain assembly 20 also incorporates a substantially ring-shaped collar 28 which is constructed for cooperative interengagement with portal 24 of catch basin 22. In its preferred construction, ring-shaped collar 28 is constructed for mating, cooperating, retained engagement within open portal 24 of catch basin 22 and incorporates a plurality of bolt-receiving apertures formed therein receiving bolts 27 and enabling collar 28 to be securely affixed to catch basin 22. This construction is preferred in order to allow roofing material extending from roof 25 to be securely clamped between collar 28 and catch basin 22, thereby assuring secure, trouble-free, cooperative mounted interengagement of roof drain assembly 20 with the roof structure itself.

In order to provide a debris restraining and water-receiving flow control member, roof drain assembly 20 also incorporates apertured strainer dome or cover 29. Apertured strainer dome or cover 29 comprises a substantially unitary member incorporating a plurality of apertures, slots, cut-outs or the like formed therein. Generally, the base of the open end of apertured dome or cover 29 is constructed for mating engagement and retention with ring-shaped collar 28.

Typically apertured dome or cover 29 is formed from cast iron, cast aluminum, plastic, or other similar material which provides a component which will be retained in the desired position by its own weight, in overlying, cooperating, interengagement with catch basin 22, while also being resistant to exposure to temperature extremes and the weather changes. By employing overlying apertured dome or cover 29 with a plurality of open slots, apertures, cut-outs, etc. formed therein, water is able to easily flow through the apertured zones of dome or cover 29 into catch basin 22 and through pipe 21, during normal conditions.

In order to complete the construction of roof drain assembly 20 of this invention, assembly 20 incorporates a unique, flood preventing, overflow dispersing tube member 30. In the preferred construction, elongated tube member 30 is affixed to apertured dome or cover 29 in a manner which assures that a substantial elongated portion of tube member 30 extends outwardly from the outer, exposed surface of dome or cover 29. In addition, in the preferred embodiment, this outwardly extending portion of elongated tube member 30 incorporates a plurality of elongated slots, apertures, or portal zones 31 formed in tube member 30 to assure ease of entry and flow of any water accumulation on roof 25 into elongated tube member 30.

In order to prevent unwanted buildup of leaves, twigs, branches, etc. in pipe 21 or catch basis 22, the outside terminating edge 32 of elongated tube member 30 comprises a cover 33 peripherally surrounding and enclosing terminating end 32. Preferably, cover or cap 33 incorporates a plurality of apertures formed therein to allow water to freely flow through cover or cap 33 into elongated tube member 30. In this way, unwanted debris is prevented from entering tube member 30, while water is able to freely flow therethrough.

In addition to extending outwardly from apertured dome or cover 29, elongated tube member 30 also extends inwardly from apertured dome or cover 29, as clearly shown in FIG. 1. In the preferred embodiment, inside terminating edge 34 of elongated tube member 30 is positioned below roof 25 in juxtaposed, spaced relationship with the lower end of catch basin 22 and the terminating edge of storm water and soil pipe 21.

It has been found that by positioning inside terminating edge 34 in the desired, preferred position below roof 25, the flow of water through elongated tube member 30 creates a low pressure zone adjacent edge 34 of elongated tube member 30. By creating this low pressure zone, loose debris covering and clogging aperture dome or cover 29 is drawn through the apertures thereof, thereby fleeing some clogged zones occurring about apertured dome or cover 29.

It has also been found that in the preferred embodiment, the inside diameter of elongated tube member 30 is substantially equivalent to the inside diameter of storm water or soil pipe 21. Preferably, the two inside diameters are equal or within about two to three inches of each other. In this way, any water buildup occurring on the roof surface can be easily accommodated and eliminated by freely passing through elongated tube member 30 and storm water or soil pipe 21. In addition, by having substantially similar diameters between tube member 30 and pipe 21, the free flow of water is assured and unwanted buildup or blockage is prevented.

In constructing roof drain assembly 20 in accordance with the present invention, elongated tube member 30 can be integrally formed as part of apertured dome or cover 29, if desired. However, in the preferred embodiment, elongated tube member 30 is constructed to be axially adjustable relative to apertured dome or cover 29. As a result, in the preferred embodiment, apertured dome or cover 29 is formed with a tube receiving portal 38 formed therein having a diameter substantially equivalent to the outside diameter of elongated tube member 30. In this way, elongated tube member 30 is quickly and easily inserted into cooperating relationship with apertured dome or cover 29 and is axially movable relative thereto.

In order to securely position elongated tube member 30 in any desired axial position relative to apertured dome or cover 29, roof drain assembly 20 of the present invention also incorporated an upper mounting ring 40 and a lower mounting ring 41. Upper mounting ring 40 is constructed for being positioned about the outside surface of elongated tube member 30 and placed in abutting contacting engagement with the outside surface of apertured dome or cover 29.

In order to securely affix elongated tube member 30 in a desired position relative to apertured dome or cover 29, upper mounting ring 40 incorporates a plurality of set screw means 42 threadedly engaged therein. Set screw means 42 are constructed for movement into and out of contacting engagement with the outside surface of elongated tube member 30 to secure elongated tube member 30 to upper mounting ring 40 in any desired position along the length of tube member 30. Once the plurality of set screw means 42 have been advanced into contacting engagement with the outside surface of elongated tube member 30, the desired axial position of elongated tube member 30 relative to mounting ring 40 is provided. Then, by positioning mounting ring 40 on the outside surface of apertured dome or cover 29, the desired placement of elongated tube member 30 relative to apertured dome or cover 29 is provided.

By employing upper mounting ring 40, the axial movement of elongated tube member 30 relative to apertured dome or cover 29 in a direction towards storm water or soil pipe 21 is assured. Although the use of upper mounting ring 40 may be sufficient to provide the desired secure affixation of elongated tube member 30 to apertured dome or cover 29, the preferred embodiment of the present invention also employs lower mounting ring 41 to assure secure mounted interengagement of elongated tube member 30 relative to apertured dome or cover 29, with movement of elongated tube member 30 prevented in both the upward and downward directions.

In the preferred construction, lower mounting ring 41 is positioned in peripheral surrounding interengagement with the outside surface of elongated tube member 30 with one surface of lower mounting ring 41 abutting the inside surface of apertured dome or cover 29. Once in this position, set screws 42 are advanced into contacting engagement with the outside surface of elongated tube member 30, thereby assuring the secure affixation of lower mounting ring 41 to elongated tube member 30 as well as providing the secure clamping engagement of elongated tube member 30 to apertured dome or cover 29.

By employing this construction, elongated tube member 30 is securely affixed to apertured dome or cover 29, with its axial movement in either the upward or downward direction being prevented. However, whenever the position of elongated tube member 30 relative to apertured dome or cover 29 is to be altered, the axial movement of elongated tube member 30 is easily attained by loosening set screws 42 of upper mounting ring 40 and lower mounting ring 41 and repositioning elongated tube member 30 in the precisely desired axial location desired. Once the desired position is established, set screws 42 are tightened into securement with elongated tube member 30, thereby securely affixing elongated tube member 30 in the precisely desired location.

As is evident to one of ordinary skill in the art, roof drain assembly 20 of the present invention is unique in the incorporation of elongated tube member 30 and the components associated therewith. It has been found that by employing elongated tube member 30 in an otherwise conventional roof drain assembly, all of the prior art problems that have plagued conventional roof drain assemblies are prevented and a unique, trouble-free roof drain assembly is achieved.

Furthermore, although roof drain assembly 20 of the present invention could be constructed with elongated tube member 30 formed in a single, fixed position as part of apertured dome or cover 29, the preferred construction of the present invention employs elongated tube member 30 axially adjustable relative to apertured dome or cover 29. In this way, the precisely desired position and optimum location for elongated tube member 30 is most easily attained.

Furthermore, as is evident from the following detailed disclosure, presently existing roof drain assemblies can be easily retrofitted to incorporate the teaching of the present invention. Since virtually all presently existing roof drain assemblies incorporate an apertured strainer dome or cover as part of the assembly, the apertured dome or cover can be removed and replaced with, or formed to accept, elongated tube member 30. In addition, by securely mounting elongated tube member 30 to the apertured dome or cover with the appropriate mounting system, such as upper and lower mounting rings 40 and 41, an existing drain assembly can be easily converted to a roof drain assembly having the benefits attained by the present invention. In this way, all existing roof drain assemblies can be upgraded to eliminate the presently existing problems and gain a benefit from the unique aspects of this invention.

In employing the present invention and attaining the optimum installation characteristics, the axial adjustability of elongated tube member 30 relative to apertured dome or cover 29 is preferably employed. In typical installations, unwanted water is retained and builds up on the roof surface due to clogging of apertured drain or cover 29 by leaves, branches, twigs, snow, ice, etc. In order to eliminate this unwanted buildup of excess water and prevent the catastrophic results that have occurred in many prior art installations, elongated tube member 30 of the present invention is employed and is axially adjusted relative to apertured dome or cover 29 to have its outside terminating edge 32 and cover or cap 33 positioned horizontally co-extensively with the maximum slope or maximum height of roof 25. Although elongated tube member 30 can be positioned higher than the maximum height of roof 25, any position above the maximum height is superfluous, since water cannot buildup beyond the maximum height of roof 25.

Once elongate tube member 30 has been axially adjusted into the precisely desired position relative to apertured dome or cover 29, elongated tube member 30 is securely affixed in its desired position by securing set screws 42 of rings 40 and 41 into secure abutting contacting interengagement with the outside surface of elongated tube member 30. Once in this position, assurance is provided that any water building up on roof 25 above apertured dome or cover 29 is easily accommodated by passage through open zones or slots 31 of elongated tube member 30.

With elongated tube member 30 providing the requisite safety overflow and control of unwanted water buildup, roof drain assembly 20 of this invention assures that excessive water buildup will be easily accommodated and eliminated in a manner which cannot be circumvented or clogged by normal debris or weather related factors. As a result, assurance is provided that excessive water buildup on flat and low sloped roofs is controlled and eliminated, providing safety and comfort to the building owners and occupants.

In carrying out the present invention, elongated tube member 30 as well as apertured dome or cover 29 may be manufactured from any suitable material conventionally employed for products of this nature. Preferably, apertured dome or cover 29 and elongated tube member 30 are formed from cast aluminum, cast iron, molded plastic material, or extruded plastic material. Other materials having equivalent characteristics can be employed with equal efficacy. The principal requirements for any material employed for elongated tube member 30 and apertured dome or cover 29 is that it be rigid, resistant to cracking or damage by temperature fluctuations, and resistant to breakage from mild shocks or contact with falling debris.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It will also be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A roof drain assembly constructed for use on flat roofs and low pitched roofs, said roof drain assembly comprising A. a base adapted to be mounted substantially co-extensive with the surface of the roof and extending therefrom below the roof surface for receiving water run off from the roof and directing the water run off to a desired location, B. a strainer cover a. mounted in overlying covering engagement with the base, and b. incorporating a plurality of apertures formed therein for enabling water on the roof to flow through said apertures into said base while controlling the entry of unwanted debris into the base, and C. an elongated, hollow tube member comprising open portal zones at both opposed terminating ends thereof a. mounted to the cover, b. extending outwardly from the cover a substantial distance therefrom and terminating at a first open, portal-defining edge, c. extending inwardly from said cover towards the base and terminating with a second open, portal-defining edge, and d. incorporating a plurality of apertures formed in the surface of said elongated tube member which extends outwardly from the cover for receiving excess water buildup on the surface of the roof and allowing the flow of said water buildup into said elongated tube member;

whereby excess water existing on the surface of the roof which is unable to flow through said strainer cover is capable of being removed by flowing through said elongated hollow, open-ended-tube member, wherein said elongated hollow tube member is further defined as being axially adjustable relative to said strainer cover to enable said elongated hollow tube member to be mounted to said cover in any desired axially adjustable position relative thereto.

2. The roof drain assembly defined in claim 1, wherein said base is further defined as being mounted to one terminating end of a storm water and soil pipe for delivering the water run off to said storm water and soil pipe for removal from the roof, and the second edge of said elongated hollow tube member is defined as being adapted to be positioned below the surface of the roof in juxtaposed, spaced relationship with the edge of the storm water and soil pipe at its juncture with the base.

3. The roof drain assembly defined in claim 1, wherein said tube member is defined as comprising a substantially cylindrical shape and the assembly further comprises D. a first holding ring a. mounted to the outside surface of the cover, b. constructed for peripherally surrounding a portion of the elongated hollow tube member, and c. incorporating a plurality of screw means threadedly engaged therewith positioned for being advanced into engagement with the outside surface of the tube member for securely mounting the tube member to the ring in any desired position along the length of said tube member.

4. The roof drain assembly defined in claim 3, and further comprising

E. a second holding ring a. mounted to the inside surface of the cover in juxtaposed spaced cooperating aligned relationship with the first holding ring, b. constructed for peripherally surrounding a portion of the elongated tube member, and c. incorporating a plurality of screw means threadedly engaged therewith and positioned for being advanced into interengaged holding relationship with the outside surface of the elongated tube member for securely mounting the elongated tube member to the second holding ring in any desired position along the length of said tube member.

5. The roof drain assembly defined in claim 1, wherein said elongated hollow tube member is further defined as being adjustably positionable and securable to said cover with said first edge spaced above the base a distance substantially equal to the maximum height of the roof.

6. The roof drain assembly defined in claim 1, wherein said second edge of said elongated hollow tube member is further defined as being axially adjustable relative to the cover to position the second edge below the surface of the roof in juxtaposed spaced adjacent relationship to the end of the storm water and soil pipe.

7. A roof drain assembly constructed for use on flat roofs and low pitched roofs, said roof drain assembly comprising A. a base adapted to be mounted substantially co-extensive with the surface of the roof and extending therefrom below the roof surface for receiving water run off from the roof and directing the water run off to a desired location, B. a strainer cover a. mounted in overlying covering engagement with the base, and b. incorporating a plurality of apertures formed therein for enabling water on the roof to flow through said apertures into said base while controlling the entry of unwanted debris into the base, and C. an elongated, hollow tube member a. mounted to the cover, b. extending outwardly from the cover a substantial distance therefrom and terminating at a first edge, c. extending inwardly from said cover towards the base and terminating with a second edge, d. incorporating a plurality of apertures formed in the surface of said elongated tube member which extends outwardly from the cover for receiving excess water buildup on the surface of the roof and allowing the flow of said water buildup into said elongated tube member, and e. a cap mounted to the first terminating edge for closing the hollow open end thereof for preventing unwanted passage of debris therethrough;

whereby excess water existing on the surface of the roof which is unable to flow through said strainer cover is capable of being removed by flowing through said elongated tube member, directly into the storm water and soil pipe.

8. The roof drain assembly defined in claim 7 wherein said cap is further defined as comprising a plurality of apertures formed therein to enable excess water to flow therethrough while preventing the passage of unwanted debris.

9. A roof drain assembly constructed for use on flat roofs and low pitched roofs and incorporating a base adapted to be mounted substantially co-extensively with the surface of the roof and extending below the roof surface, a strainer cover mounted in overlying covering engagement with the base and incorporating a plurality of apertures formed therein for allowing water to flow therethrough, while controlling the flow of unwanted debris therethrough, the improvement comprising an elongated hollow tube member incorporating open ends at both terminating ends thereof to assure free flow of water and debris and mounted to the cover with a portion of said elongated hollow tube member extending above said cover, incorporating apertures formed therein for enabling excess water on the roof to be removed by passage through said apertures and said elongated tube member, and being mounted to the cover for axial adjustability relative thereto, thereby enabling said elongated tube member to be positioned in any desired axial length above the cover.

10. The roof drain assembly defined in claim 9, wherein said assembly further comprises clamp means cooperatively associated with the cover and peripherally surrounding the elongated hollow tube member in holding interengagement therewith for enabling said elongated tube member to be moved into any desired axial position and securely retained in that position by securement of said clamp means.

11. The roof drain assembly defined in claim 10, wherein said hollow elongated tube member is further defined as comprising a substantially cylindrical shape and said clamp means is further defined as comprising a first holding ring mounted to the outside surface of the cover member in juxtaposed spaced cooperating relationship with the elongated tube member for enabling the tube member to be adjusted in any desired position and securely affixed to said ring by screw means contained therein.

12. The roof drain assembly defined in claim 11, wherein said clamp means further comprises a second holding ring mounted to the inside surface of the cover in juxtaposed, spaced cooperating relationship with the first holding ring for peripherally surrounding a portion of the elongated tube member and enabling the tube member to be further securely retained in any desired axial position relative thereto.

13. The roof drain assembly defined in claim 9, wherein said elongated hollow tube member is further defined as comprising an inside terminating edge movably adjustable relative to the cover with said inside terminating edge being positioned below the roof surface in juxtaposed spaced cooperating relationship with the base of said drain assembly.

* * * * *